US005723827A

United States Patent [19]

Sasaki et al.

[11] Patent Number: 5,723,827

[45] Date of Patent: Mar. 3, 1998

[54] NOISE SUPPRESSING MUFFLER

[75] Inventors: Akira Sasaki, Yokosuka; Kazushige Maeda, Zushi; Haruki Yashiro, Fujisawa, all of Japan

[73] Assignee: Nissan Motor Co., Ltd., Yokohama, Japan

[21] Appl. No.: 576,967

[22] Filed: Dec. 26, 1995

[30] Foreign Application Priority Data

Dec. 26, 1994 [JP] Japan ..... 6-323336

[51] Int. Cl.[6] ..... F01N 1/00

[52] U.S. Cl. ..... 181/237; 181/253; 181/254

[58] Field of Search ..... 181/237, 253, 181/254; 60/324; 137/596.1, 596.2

[56] References Cited

U.S. PATENT DOCUMENTS

| | | | |
|---|---|---|---|
| 3,969,895 | 7/1976 | Krizman | 60/324 |
| 4,079,808 | 3/1978 | Mizuno et al. | 181/237 |
| 4,179,883 | 12/1979 | Nishiyama et al. | 181/237 |
| 4,264,344 | 4/1981 | Ludecke et al. | 60/324 |
| 4,484,659 | 11/1984 | Buchwalder | 181/237 |
| 5,208,429 | 5/1993 | Field | 181/237 |
| 5,435,347 | 7/1995 | Gillingham | 181/237 |
| 5,452,578 | 9/1995 | Barber | 60/324 |
| 5,614,699 | 3/1997 | Yashiro et al. | 181/254 |

FOREIGN PATENT DOCUMENTS 57-13832 1/1982 Japan .

*Primary Examiner*—Eddie C. Lee
*Attorney, Agent, or Firm*—Foley & Lardner

[57] ABSTRACT

A plurality of chambers are partitioned in a muffler by a baffle board. The muffler is provided with an exhaust gas passage for discharging exhaust gas outside the muffler via these chambers and a valve that bypasses a part of the exhaust passage. This valve opens according to the exhaust gas pressure. Also provided are a mechanism for pushing the valve in a closing direction, and a mechanism for damping the shock when the valve closes. Thus, valve closing noise is suppressed, and exhaust gas noise is further suppressed.

10 Claims, 10 Drawing Sheets

NOISE SUPPRESSING MUFFLER

FIELD OF THE INVENTION

This invention relates to an exhaust noise suppressor that reduces the noise of an engine exhaust using a muffler.

BACKGROUND OF THE INVENTION

In automobile engine exhaust devices, it is important to suppress engine noise over the whole range of engine speed while suppressing energy losses due to noise suppression. In this context, Japanese Jikkai. Sho 57-13832 published by the Japanese Patent Office in 1982, discloses a muffler having a valve that opens due to exhaust pressure. In this muffler, an air flow cross-section is increased by the valve opening at high engine speed, and energy losses due to increase of back pressure are thereby prevented.

The interior of this muffler is divided into a plurality of extended chambers by baffle boards, these chambers being connected by an exhaust passage. The valve comprises an aperture formed in a baffle board and a valve body that closes the aperture when it comes in close contact with the board, this valve body being pushed in the closing direction by a spring. At low engine speeds, exhaust gas flows through the muffler only via the exhaust passage, whereas at high engine speeds, the exhaust pressure pushes the valve body open against the force of the spring so that exhaust gas flows through the muffler via both the exhaust passage and the aperture opened by the valve. In this way, the air flow cross-section at high engine speed is increased while energy losses and noise due to high speed exhaust are reduced.

In this muffler, however, there is a problem in that the valve body collides with the baffle board when the valve closes, generating impact noise. When the engine speed often varies, this impact noise is often generated.

SUMMARY OF THE INVENTION

It is therefore an object of this invention to prevent impact noise when a valve provided in a muffler and driven by an exhaust pressure is closed.

It is a further object of this invention to prevent the generation of this impact noise by a simple means.

In order to achieve the above objects, this invention provides a noise suppressor for attenuating a noise of engine exhaust gas, comprising a muffler, a baffle board for partitioning the muffler into a plurality of chambers, an exhaust gas passage for discharging the exhaust gas outside the muffler via the chambers, a bypass valve for bypassing a part of the passage, the valve being opened by a pressure of the exhaust gas, a mechanism for pushing the valve in the direction of closing, and a mechanism for damping a shock when the valve is closed.

It is preferable that the valve comprises a hole formed in the baffle board and a valve body for closing the hole by coming into close contact with the baffle board, and that the damping mechanism comprises a damper attached to one of the valve and the baffle board, In this case, it is further preferable that the damper comprises a noise absorbing material disposed around the hole and a mechanism for dispersing an impact exerted on the absorbing material.

In this case, it is further preferable that the dispersing mechanism is a stainless steel mesh covering the noise absorbing material.

In this case, it is further preferable that the stainless mesh is attached to one of the baffle board and valve body by welding.

Alternatively, the baffle board comprises hooks for attaching the damping mechanism at a predetermined position.

In this case, it be further preferable that the valve body is provided with recesses at positions corresponding to the hooks.

Alternatively, the valve body comprises hooks for attaching the damping mechanism at a predetermined position.

In this case, the baffle board is provided with recesses at positions corresponding to the hooks.

Alternatively, the suppressor further comprises a guide attached to the baffle board, the guide being disposed around the circumference of the valve body in a closed position so as to support the damper in a predetermined position.

The details as well as other features and advantages of this invention are set forth in the remainder of the specification and are shown in the accompanying drawings.

DESCRIPTION OF THE PREFERRED EMBODIMENTS

Figure 1:
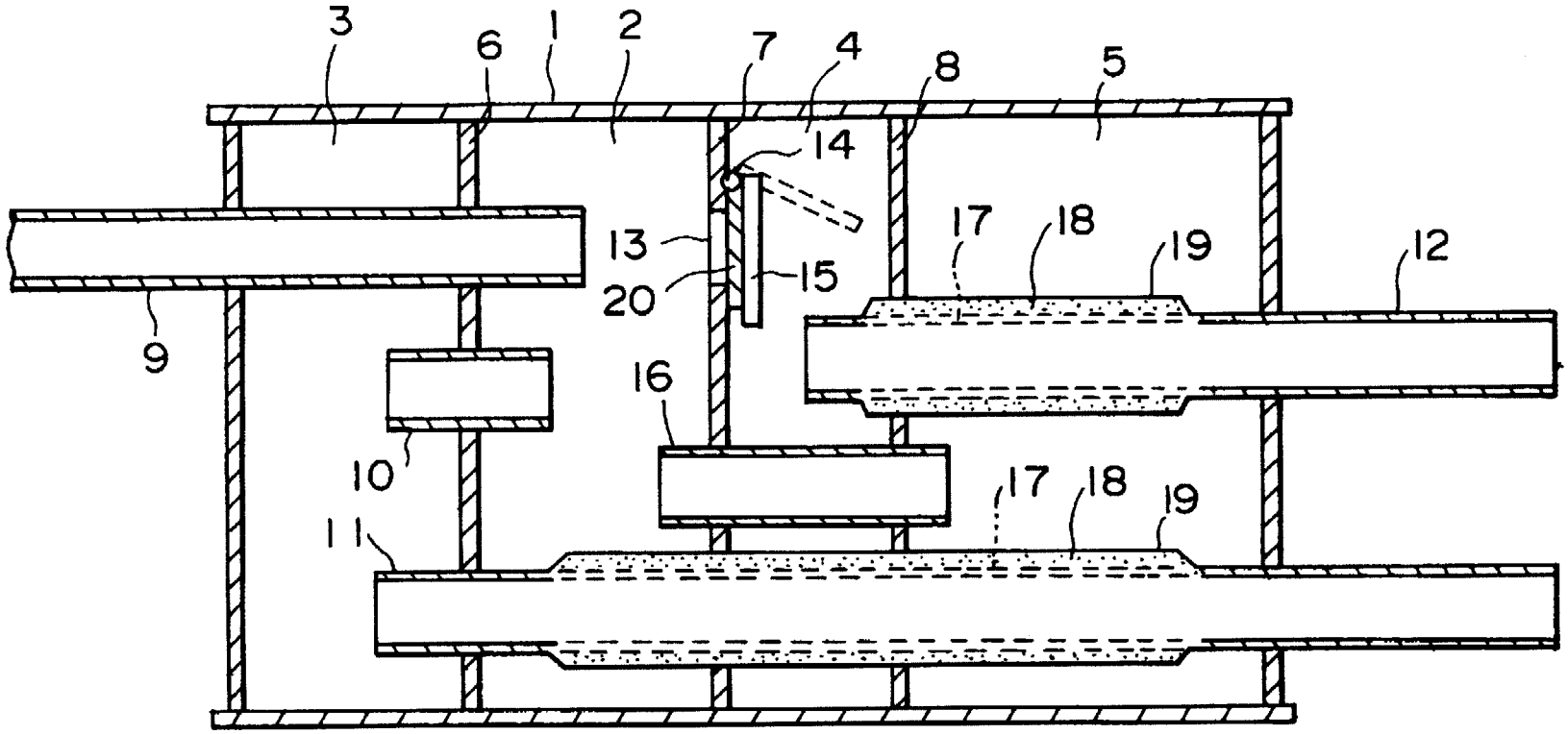
FIG. 1 is a vertical sectional view of a muffler according to this invention.

Referring to FIG. 1 of the drawings, a muffler 1 of an automobile engine is connected to an inlet tube 9 that leads engine exhaust into the muffler 1, and tail tubes 11, 12 that discharge exhaust gas that has passed through the muffler 1 into the atmosphere.

The muffler 1 has an elliptical horizontal cross-section. The interior of the muffler 1 is partitioned into chambers 4, 3, 2 and a resonance chamber 5 by baffle boards 6, 7 and 8.

The inlet tube 9 passes through the chamber 3 and opens into the chamber 2.

The chambers 2, 3 are connected by a tube 10 that passes through the baffle board 6. The chamber 3 and resonance chamber 5 are connected by a tube 16 that passes through the chamber 4.

One end of the raft tube 11 opens onto the chamber 3. The tail tube 11 passes through the chambers 2, 4 and resonance chamber 5, opens onto the outside of the muffler 1. A plurality of holes 17 connecting the inside and outside of the tall tube 11 are formed by the wall of the part of the tube passing through the chambers 2, 4 and the resonance chamber 5. A noise absorbing material 18 is wound around the outer circumference of the tube to attenuate air-flow noise. The outer circumference of the noise absorbing material 18 is covered by an outer tube 19 to prevent exhaust gas leaking from the tall tube 11 into the chambers 2, 4 and resonance chamber 5.

One end of the tall tube 12 opens into the chamber 4. The tail tube 12, which is disposed parallel to the tail tube 11, passes through the resonance chamber 5 and opens onto the outside of the muffler 1. A plurality of holes 17 similar to those in the tail tube 11 are formed in the part of the tube 12 that passes through the resonance chamber 5. As in the case of the tail tube 11, the holes 17 are covered by the noise absorbing material 18 and outer tube 19.

A valve is provided in the baffle board 7 to bypass the exhaust passage leading from the chamber 2 to outside the muffler 1 via the tube 10, chamber 3 and tail tube 11, so as to discharge exhaust gas in the chamber 2 to outside the muffler 1 via the chamber 4 and tail tube 12.

Figure 2:
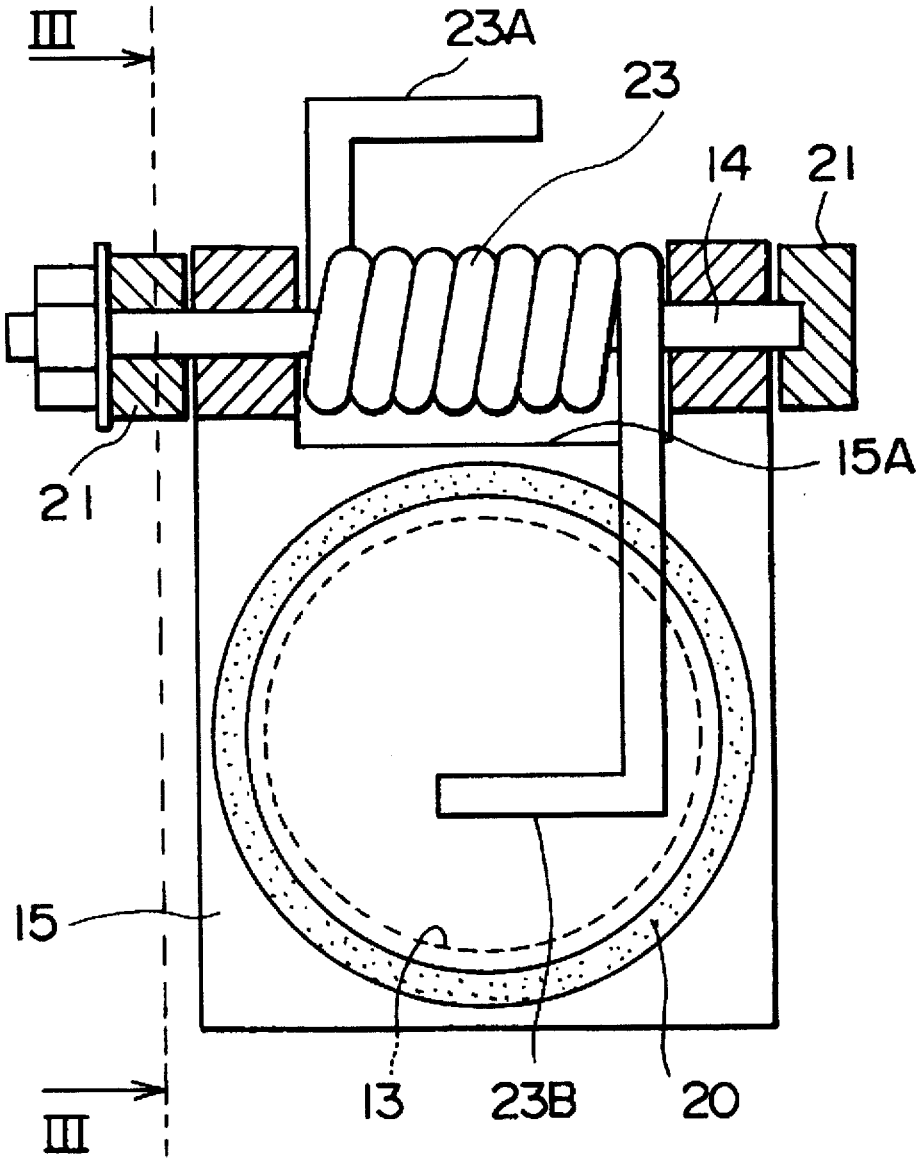
FIG. 2 is a front view of a valve according to a first embodiment of this invention.
Figure 3:
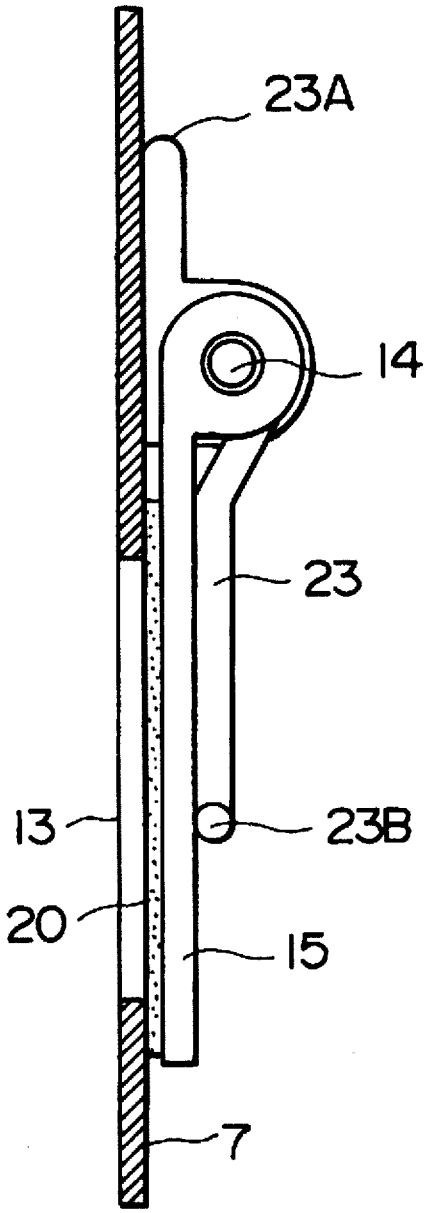
FIG. 3 is a sectional view of the valve taken along the line III—III in FIG. 2.

As shown in FIGS. 2 and 3, this valve comprises a circular hole 13 formed in a baffle board 7 opposite an aperture in the inlet tube 9, and a valve body 15 that closes the hole 13. The valve body 15 is supported free to swing in the baffle board on a shaft 14. The valve body 15 comprises a rectangular member of such dimensions that it can close the hole 13. A notch 15A is formed in the valve body 15 in the vicinity of the shaft 14, the shaft 14 passing through part of both sides of this notch 15A. Both ends of the shaft 14 are supported on the baffle board 7 by a bearing 21.

On the inside the notch 15A, a return spring 23 fits on the outer circumference of the shaft 14. The return spring 23 comprises ends 23A, 23B that are bent into an L shape. The end 23A of the return spring 23 is in contact with the baffle board 7 and the end 23B is in contact with the rear surface of the valve body 15 so as to push the valve body 15 in such a direction as to close the hole 13.

A ring shaped damper 20 that comes into contact with the valve body 15 when the valve is closed, is fixed on the surrounds of the hole 13.

Figure 4:
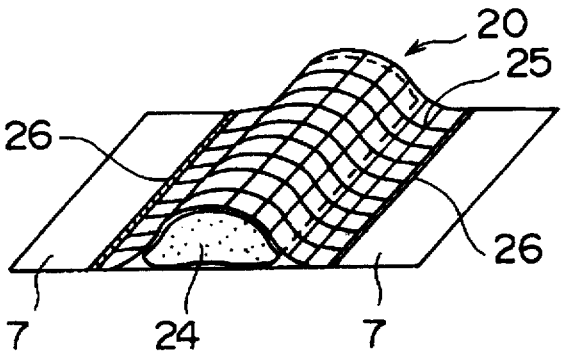
FIG. 4 is a perspective view of a noise absorbing material according to the first embodiment of this invention.

The damper 20 comprises a stainless steel mesh 25 covering a shock absorbing material 24 having an effectively semicircular cross-section, the two ends 26 of the mesh 25 being fixed to the baffle board 7 by welding, as shown in FIG. 4.

The action of this muffler 1 will now be described. Exhaust gas from the engine flows into the chamber 2 from the inlet tube 9. Exhaust gas that flows into the chamber 2 attenuates noise or pressure waves in the resonance chamber 5 via the tube 16, and flows into the chamber 3 via the tube 10. As the exhaust gas pressure at low engine speeds is low, the valve body 15 does not open, all the exhaust gas in the chamber 2 flows into the chamber 3, and is discharged to the atmosphere via the tail tube 11.

In this case, by setting the capacity of the chambers 2, 3 and resonance chamber 5 according to the low engine speed region, a pulsation component of the exhaust gas in synchronism with the engine speed is attenuated when it flows through the chambers 2 and 3. Noise attenuation also takes place due to the holes 17 in the tail tube 11 and the noise absorbing material 24.

At high engine speeds, when the pressure of the exhaust gas pressure flowing from the inlet tube 9 rises and exceeds a predetermined pressure, the valve 15 is pushed open against the force of the return spring 23. Part of the exhaust gas in the chamber 2 therefore flows into the chamber 4 and is discharged to the atmosphere from the raft tube 12. Hence, by discharging exhaust gas from the muffler 1 via two tail tubes 11, 12, energy losses in the high engine speed region where the exhaust gas flow rate increases, are lessened, thus preventing drop of engine power and decreasing air flow noise due to a high exhaust-gas flow rate.

When the exhaust gas pressure falls, the open valve body 15 is pushed by the force of the return spring 23 so that it rests on the damping member 20 and the hole 13 is closed.

If the exhaust pressure rapidly falls, the valve body 15 strikes the damper 20 sharply, however the impact is damped due to elastic deformation of the absorbing material 24 and impact noise is suppressed. The muffler 1 therefore does not generate noise even when the valve body 15 opens and closes frequently. As the noise absorbing material 24 is covered by the stainless steel mesh 25, the noise absorbing material 24 is not torn due to the impact of the valve body 15, and as the stainless steel mesh 25 disperses the impact, concentration of the impact at specific sites is avoided.

Time-dependent deterioration of the damper 20 is therefore small, and durability of the muffler 1 is improved as a result.

Figure 5:
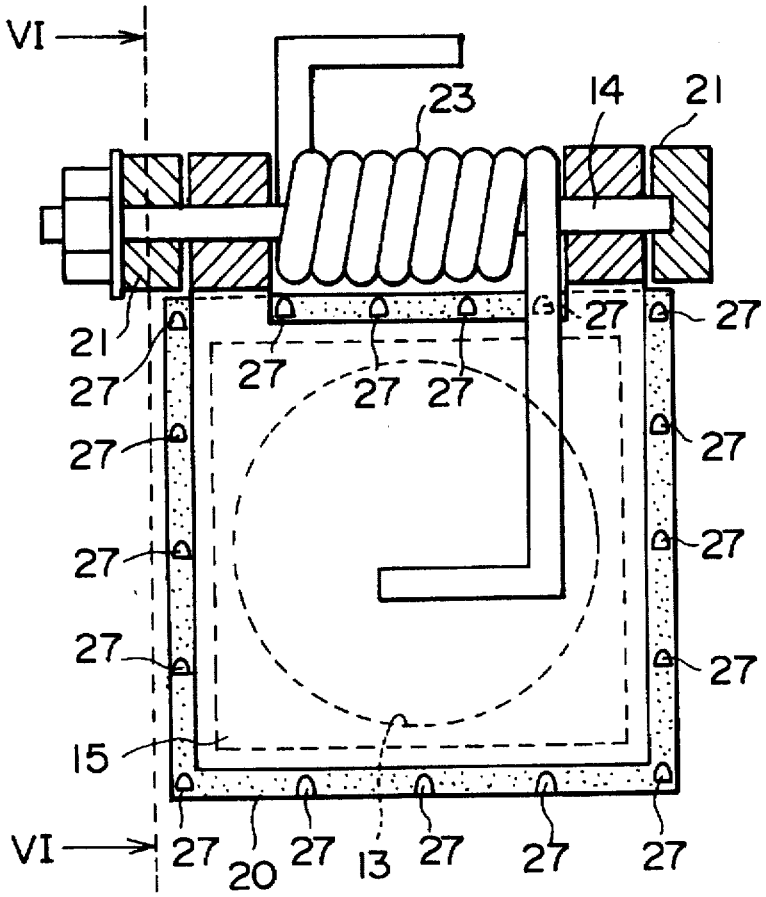
FIG. 5 is a front view of a valve according to a second embodiment of this invention.
Figure 6:
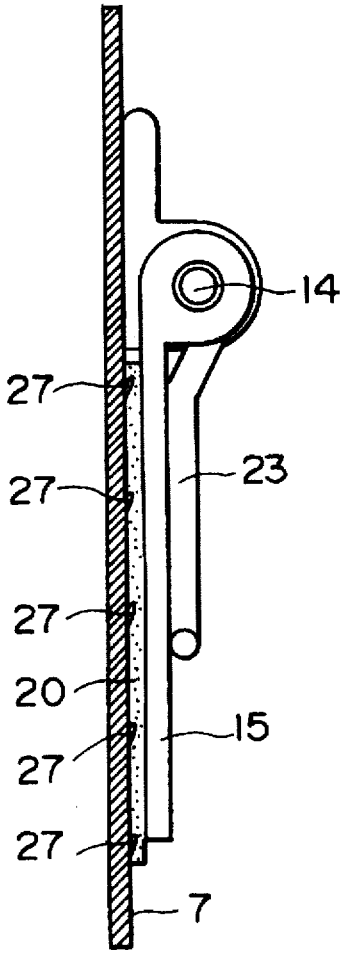
FIG. 6 is a sectional view of the valve taken along a line VI—VI in FIG. 5.
Figure 7:
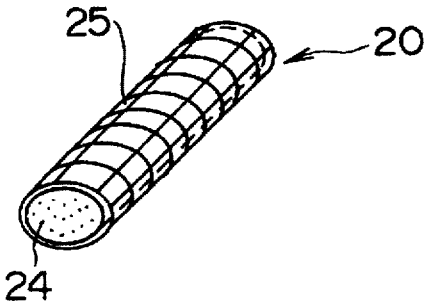
FIG. 7 is a perspective view of a noise absorbing material according to the second embodiment of this invention.

FIGS. 5–7 show a second embodiment of this invention.

Here, the damper 20 is attached by a plurality of hooks 27 set in the baffle board 7. As shown in FIG. 5, the hooks 27 project with their ends pointing upward at a predetermined interval along the circumference of the valve body 15.

The stainless steel mesh 25 is tucked around the outer circumference of the noise absorbing material 24 having an effectively elliptical cross-section, as shown in FIG. 7, and the hooks 27 are driven into the mesh so as to attach the damper 20 to the baffle board 7 as shown in FIG. 6. Due to the use of these hooks 27, installation of the damper 20 is easy, and the muffler manufacturing process is simplified.

Figure 8:
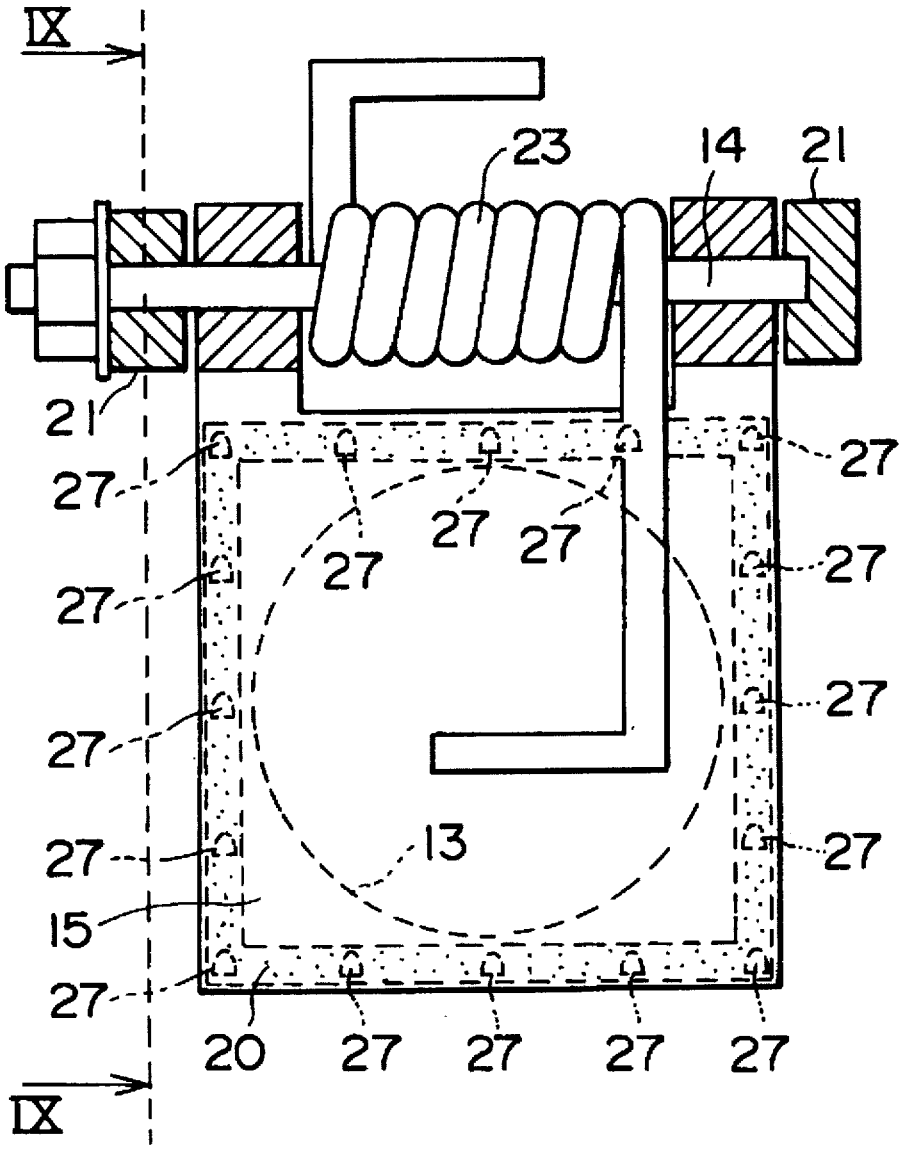
FIG. 8 is a front view of a valve according to a third embodiment of this invention.
Figure 9:
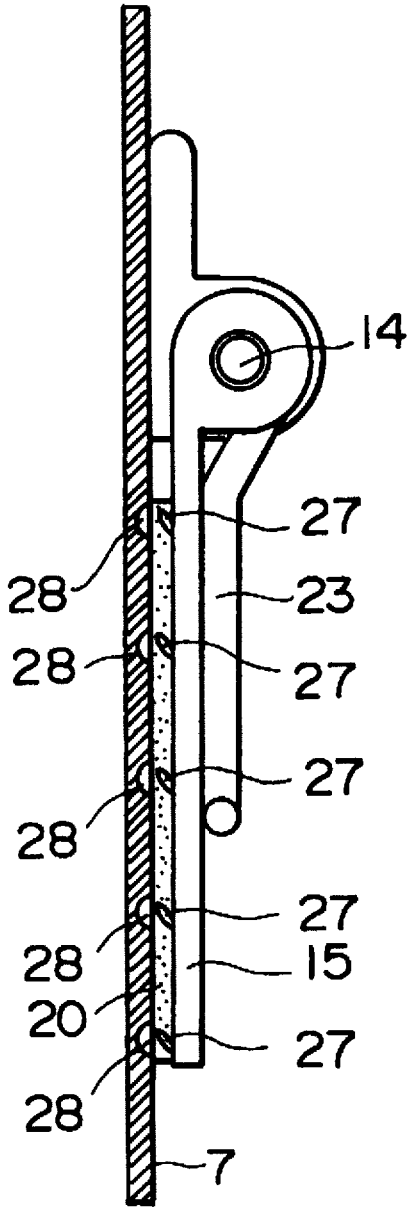
FIG. 9 is a sectional view of the valve taken along a line IX—IX in FIG. 8.

FIGS. 8 and 9 show a third embodiment of this invention.

According to this embodiment, the hooks 27 are provided in the valve body 15 and the damper 20 is attached to the valve body. Recesses 28 are formed at positions corresponding to the hooks 27 in the baffle board 7 as shown in FIG. 9. The damper 20 is substantially identical to the damper 20 according to the second embodiment.

When the valve body 15 is closed, the hooks 27 project into the recesses 28 due to elastic deformation of the damper 20, and as the hooks 27 do not touch the baffle board 7 directly, they do not generate any impact noise or deteriorate. In this case also, installation of the damper is completed merely by driving the hooks 27 into the damper 20 so installation is easy, and the muffler manufacturing process is simplified.

The hooks 27 may also be provided at positions in the baffle board 7 where it faces the valve body 15, recesses being provided in the valve body 15.

Figure 10:
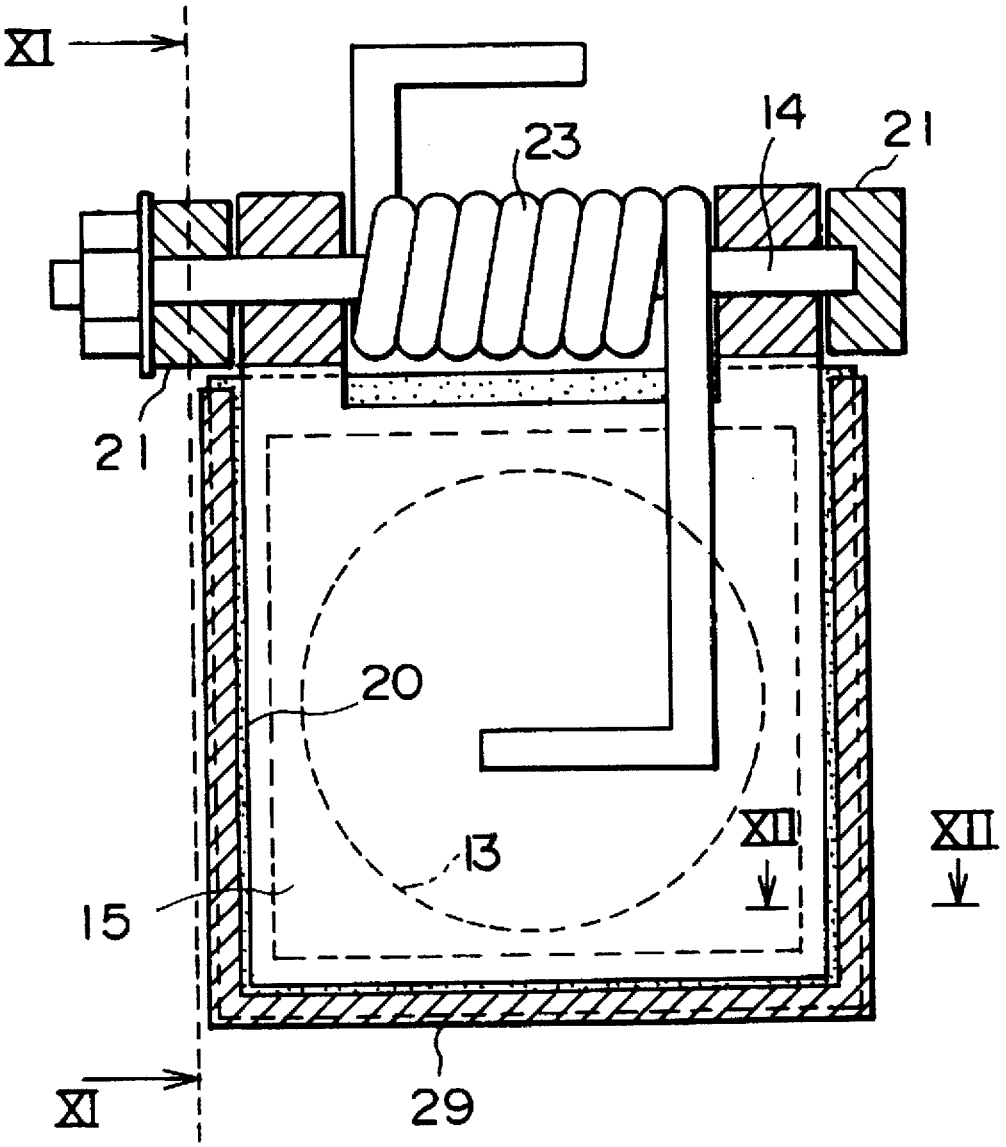
FIG. 10 is a front view of a valve according to a fourth embodiment of this invention.
Figure 11:
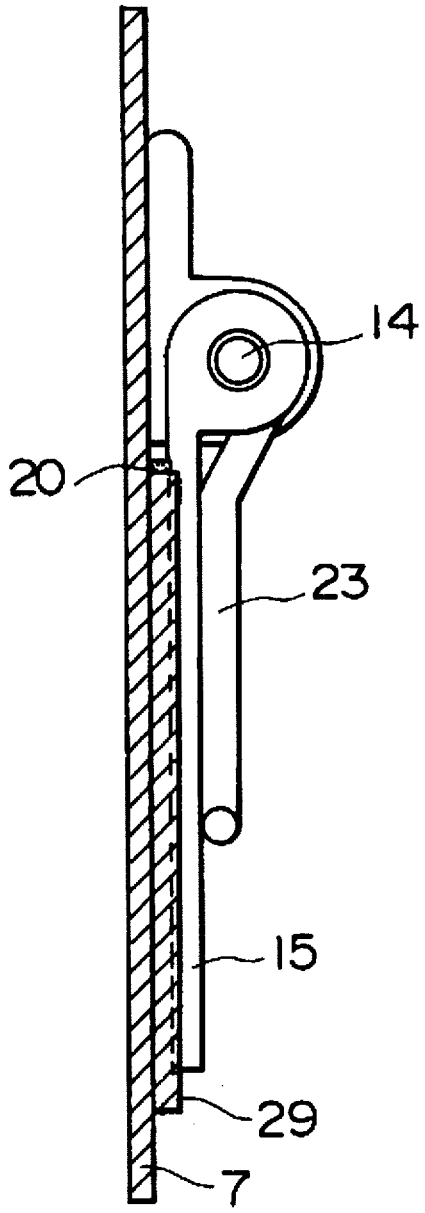
FIG. 11 is a sectional view of the valve taken along a line XI—XI of FIG. 10.
Figure 12:
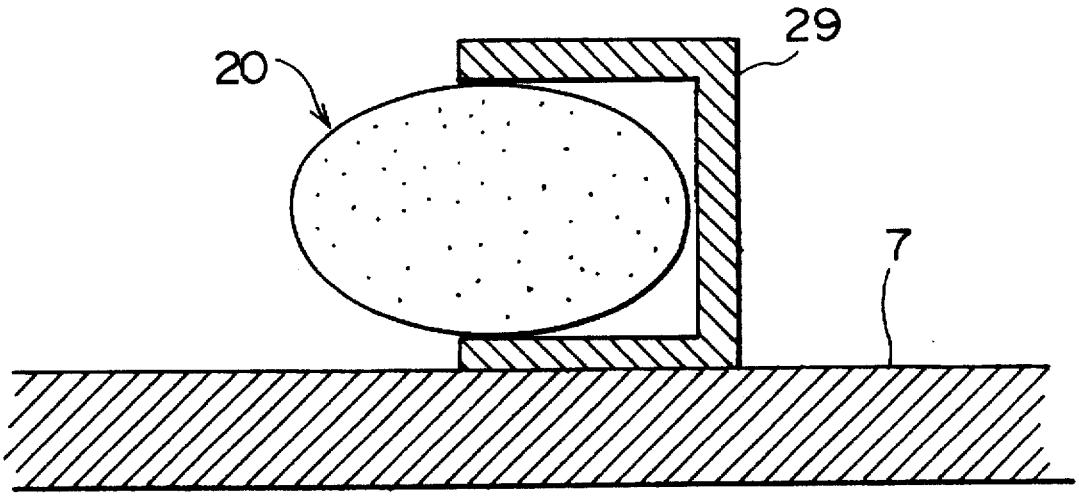
FIG. 12 is an enlarged horizontal sectional view of a guide and damping material taken along a line XII—XII of FIG. 10.

FIGS. 10–12 show a fourth embodiment of this invention.

According to this embodiment, a guide 29 having a U-shaped cross-section is fixed to the baffle board 7 as Shown in FIG. 10, a damper 20 having the same construction as that of the second embodiment being supported by the guide 29. The guide 29 is disposed around the three sides of the valve body 15 such that its opening of the "U" is oriented towards the valve body 15 in its closed position. When the valve body 15 is closed, the guide 29 does not come into contact with the valve body 15, only the damper 20 that projects from the guide 29 coming into contact with the valve body 15. As a result of this contact, the damper 20 absorbs the impact noise between the valve body 15 and baffle board 7.

To install the damper 20, it need merely be inserted in the guide 29, and as there is no need to attach it by welding as in the first embodiment, installation is easy and the muffler manufacturing process is simplified. If the guide 29 is formed of an elastic resin or the like, impact absorbing capacity is further enhanced.

The embodiments of this invention in which an exclusive property or privilege is claimed are defined as follows:

1. A noise suppressing muffler for attenuating noise from engine-exhaust gas, comprising:

a housing;

at least one baffle board for partitioning the housing into a plurality of chambers;

an exhaust gas passage for discharging the exhaust gas outside the housing through the chambers;

a bypass valve for bypassing a part of the passage, wherein the valve comprises a hole formed in the baffle board and a valve body for closing the hole by coming into close contact with the baffle board, the valve being adapted to be opened by pressure from the exhaust gas;

means for pushing the valve body toward a closing position;

a noise absorbing material around the hole; and means for dispersing an impact exerted on the noise absorbing material by closing of the valve body.

2. A noise suppressing muffler as defined in claim 1, wherein the dispersing means is a stainless steel mesh covering the noise absorbing material.

3. A noise-suppressing muffler as defined in claim 2, wherein the stainless steel mesh is attached by welding to one of the baffle board and valve body.

4. A noise-suppressing muffler as defined in claim 1, wherein the baffle board has hooks for attaching the noise absorbing material at a predetermined position.

5. A noise-suppressing muffler as defined in claim 4, wherein the valve body is provided with recesses at positions corresponding to the hooks.

6. A noise-suppressing muffler as defined in claim 1, wherein the valve body has hooks for attaching the noise absorbing material at a predetermined position.

7. A noise-suppressing muffler as defined in claim 6, wherein the baffle board is provided with recesses at positions corresponding to the hooks.

8. A noise-suppressing muffler as defined in claim 1, further comprising a guide attached to the baffle board, the guide being disposed around the circumference of the valve body in a closed position to support the noise absorbing material and the dispersing means in a predetermined position.

9. A muffler comprising:

a housing;

an exhaust gas inlet extending into the housing for introducing an exhaust gas from an engine;

at least one baffle board for partitioning the housing into a plurality of chambers, the baffle board having a valve;

first and second exhaust gas passages for discharging the exhaust gas outside the housing, wherein the second exhaust gas passage passes through the valve, wherein the valve comprises a hole in the baffle board and a valve body for closing the hole, the valve being movable between an open position and a close position, the valve body being biased toward the close position and being adapted to be opened upon exertion of pressure from the exhaust gas greater than a predetermined pressure;

a noise absorbing material placed around one of the hole and the valve body; and an impact dispersing member on the noise absorbing material to disperse the impact exerted on the noise absorbing material by closing of the valve body.

10. A noise suppressor as defined in claim 9, wherein the impact dispersing member is a stainless steel mesh covering the noise absorbing material.

* * * * *